US005484308A

United States Patent [19]

Gotz et al.

[11] Patent Number: 5,484,308

[45] Date of Patent: Jan. 16, 1996

[54] DATA COMMUNICATIONS OUTLET KIT

[75] Inventors: Klaus-Peter Gotz, Lorsch; Rainer Schwan, Einhausen; Günter Feldmeier, Lorsch, all of Germany

[73] Assignee: The Whitaker Corporation, Wilmington, Del.

[21] Appl. No.: 230,054

[22] Filed: Apr. 15, 1994

[30] Foreign Application Priority Data

Apr. 29, 1993 [GB] United Kingdom ..... 9308850

[51] Int. Cl.[6] ..... H01R 13/60

[52] U.S. Cl. ..... 439/536; 439/676

[58] Field of Search ..... 439/535, 536, 439/676

[56] References Cited

U.S. PATENT DOCUMENTS

| | | | |
|---|---|---|---|
| 4,874,904 | 10/1989 | DeSanti | 439/536 X |
| 5,122,069 | 6/1992 | Brownlie et al. | 439/535 X |
| 5,356,311 | 10/1994 | Liu | 439/536 |

*Primary Examiner*—Eugene F. Desmond
*Attorney, Agent, or Firm*—Adrian J. LaRue; Eric J. Groen

[57] ABSTRACT

A data communications outlet kit is shown comprising a mounting frame, an outlet connector module and an external outlet cover. The outlet connector module comprises a housing, an edge connector and a connector insert, whereby the edge connector is for electrical connection between a data communications cable and the insert and the insert is for making electrical connection between the edge connector and an external connector, such as a modular plug. The outlet connector housing comprises an outlet housing box integrally molded to an outlet box cover by thin breakable webs, and to the cover are integrally molded two strain relief means that can be broken off the cover, one for a smaller cable diameter range and the other for a larger cable diameter range. Tapered pegs provisionally support the strain relief means to the cover while mounting the cover to the rear of the outlet housing box, engaging in holes in the strain relief means such that the strain relief means can be held thereon with a wedge effect. The insert is inserted in a front cavity portion of the outer housing box. The assembled outlet connector can be securely mounted to the outlet mounting cover by tilting the outlet connector such that the diagonal formed by an upper rear corner and a lower front corner of the outlet connector is roughly parallel to the plane of a base of the outlet cover.

21 Claims, 13 Drawing Sheets

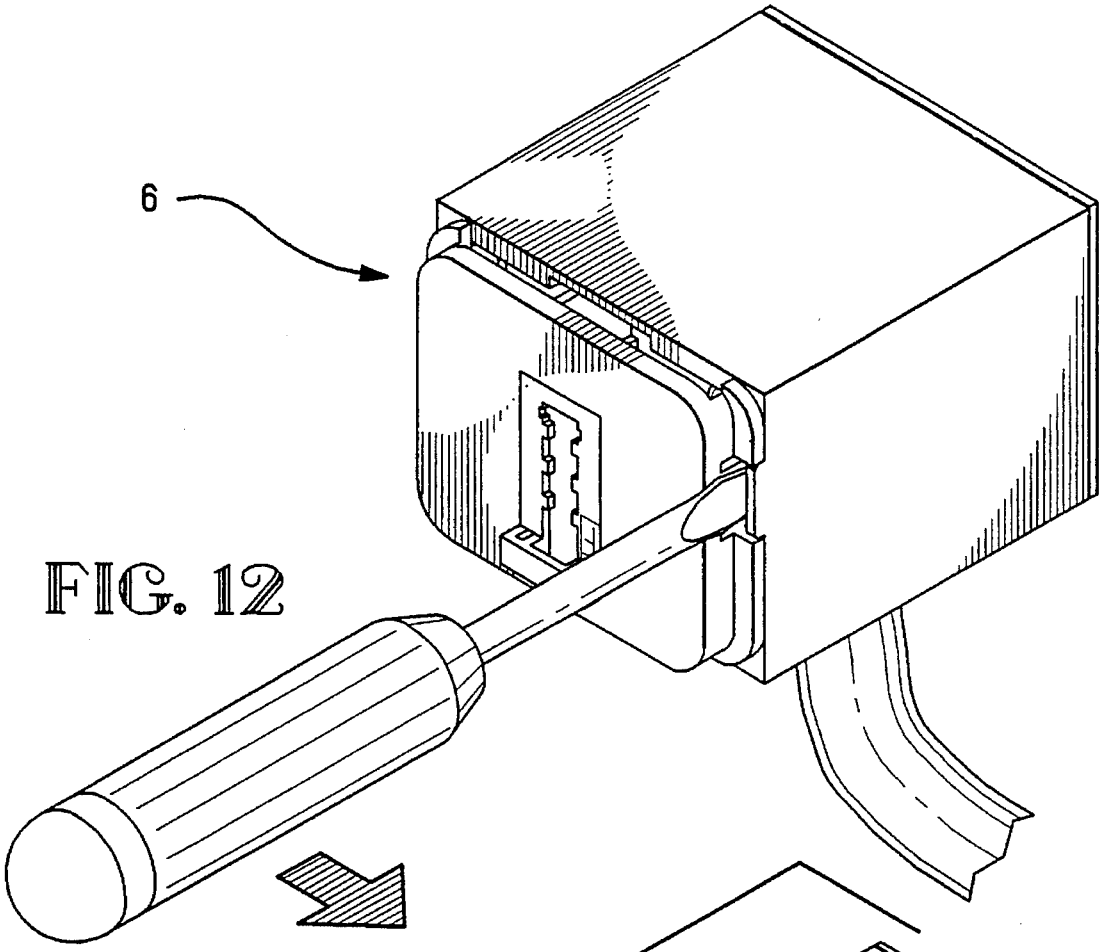
FIG. 12
FIG. 13A
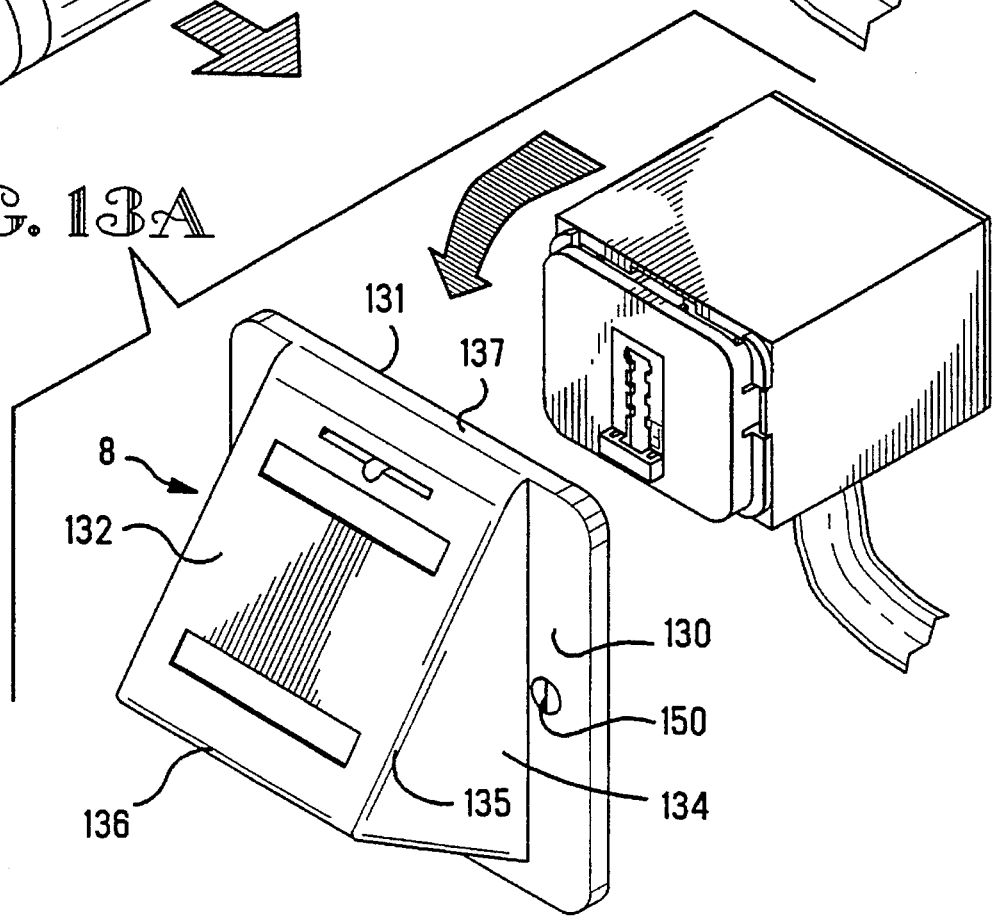

DATA COMMUNICATIONS OUTLET KIT

BACKGROUND OF THE INVENTION

1. Field of the Invention

This invention relates to a kit for a data communications outlet, and in particular a kit with a housing of one integral part that is breakably separable into individual housing components for assembly.

1. Description of the Prior Art

The need for a flexible wiring arrangement and provision for future applications has been increasingly important in the building industry. In order to adapt to the rapidly changing technology and also, for example, to the future growth of a company and their data communications needs, it is desirable that the communications connections between the various rooms of a building be quickly readaptable to a new wiring arrangement. In the past, as the data communication requirements grew, extra cables often had to be installed within the building, this being very expensive and adding a mass of wires, increasing repair and maintenance times which also required specialists.

In order to overcome these problems, the communications cabling concept has changed to a more flexible system, for example as shown in publication WO 87/07775, whereby a multiple purpose data communications cable (for example comprising data and/or telephone cables apart from the standard insulated electrical conducting wires) is distributed throughout the building and connecting these cables to the communications outlet. These outlets are designed such that there is an insert that makes data communications connection between a wall, floor or structure mounted connector box which is connected to the cable, and a user plug connected to a portable device for example. If this portable device is to be removed and replaced by another device requiring a different data communications connection, the insert is quickly removed from the connector box and replaced with another insert adapted to receive the plug of the new device.

Depending on the users needs therefore, the inserts are usually offered separately from the outlet connector box.

This outlet connector box is mounted separately to a structure, and it is desirable to have an outlet connector that can be installed in many different types of structures such as a wall or a floor or a cable canal, in order to satisfy as many needs as possible with only one set of parts.

It is also desirable to offer kits for assembly that have as few loose pieces as possible as this reduces the inventory and handling costs.

To enable the fixed outlet connector to be installable in many different structures, it is often necessary that the required mounting depth within the structure for this connector is quite small and yet it is desirable that the exterior portion of the outlet connector not project far out as the risk of damage thereto by people or moving of furniture, for example, is quite high.

It is also desirable to have quick access to the outlet connector such that the insert can be quickly removed or for modification or reparation of the outlet connector box.

SUMMARY OF THE INVENTION

It is an object of this invention, therefore, to provide a communications outlet kit comprising few parts and that is cheap to manufacture, to handle and to assemble.

Yet another object of this invention, is to provide a communications outlet kit that can be mounted to relatively shallow depth structures without increasing the risk of the plug being broken because of exaggerated protrusion into the room.

Yet another object of this invention, is to provide a communications outlet kit that allows quick changing of an insert and quick access to all parts of the outlet connector for modification or reparation thereof.

The above mentioned objects of this invention have been achieved by providing a communications outlet kit for connection between an electrical communications cable and an external connector, the outlet comprising a connector module, the connector module comprising a housing, an insert for electrical connection to the external connector, and a connector for electrical connection between the insert and the communications cable, the insert and the connector mountable to the housing; the outlet characterized in that the housing is one integral part that is breakably separable into individual housing components for assembly of the connector module.

Yet another object of this invention has been achieved by providing a communications outlet kit whereby the outlet connector module is fixed to an external communications outlet cover, the cover then being fixed to a mounting frame, the mounting frame securely fixed to a structure, wall or floor.

Yet another object of this invention, has been achieved by fixing the outlet connector to the external communications outlet cover such that the diagonal formed by opposing corners of the outlet connector housing, is approximately parallel to the outer surface of the structure or wall.

BRIEF DESCRIPTION OF THE DRAWINGS

FIG. 7 shows insertion of the edge connector into a connector housing box, FIG. 8 shows breaking off of a cover from the connector housing box, FIG. 9 shows breaking off of strain relief means on the cover and provisionally supporting a strain relief means on the cover for closing the cover to the connector housing box, FIG. 10 shows clamping of the strain relief means, and FIG. 11 shows insertion of a communications insert into a front face of the connector housing box;

FIG. 12 shows how the communications insert can be extracted from the connector housing box;

FIGS. 13*a* to 13*c* show how the communications outlet connector is locked to a communications outlet cover.

DETAILED DESCRIPTION OF THE PREFERRED EMBODIMENT

Figure 1:
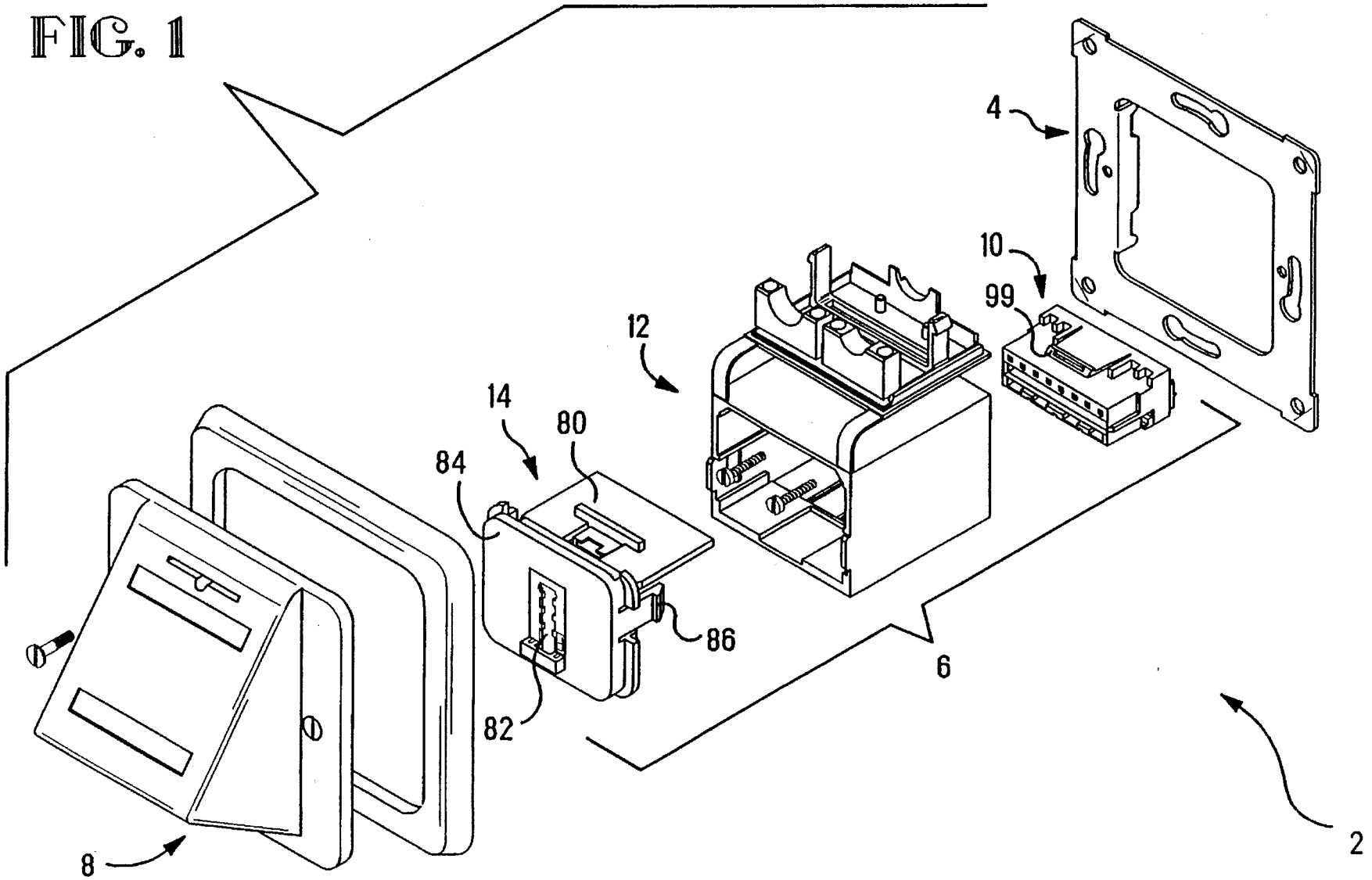
FIG. 1 is an isometric view of the separate kit parts for assembly in order to make a data communications outlet.

With reference first to FIG. 1, a communications outlet kit generally shown at 2 is shown comprising a mounting frame 4, a communications outlet connector in separate components generally shown at 6, and an outlet cover generally shown at 8. The communications outlet connector 6, is shown comprising an internal communications connector 10, an outlet connector housing 12, and a communications connector insert 14.

Figure 2:
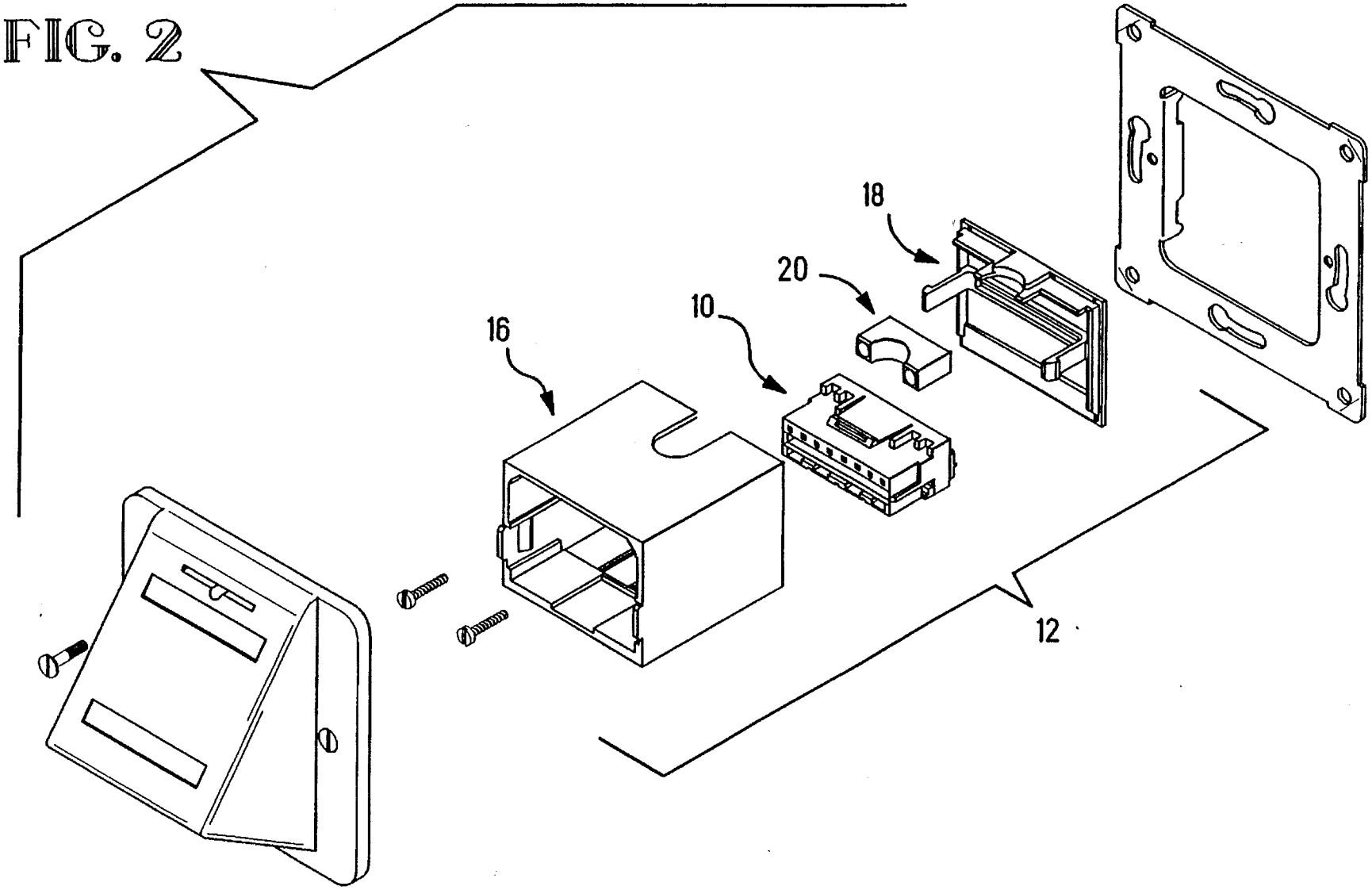
FIG. 2 is another isometric view of some of the kit parts of FIG. 1.

With reference now to FIG. 2, the outlet connector housing 12 is shown comprising an outlet housing box 16, an outlet housing box cover 18 and a shielding strain relief means 20.

Figure 3:
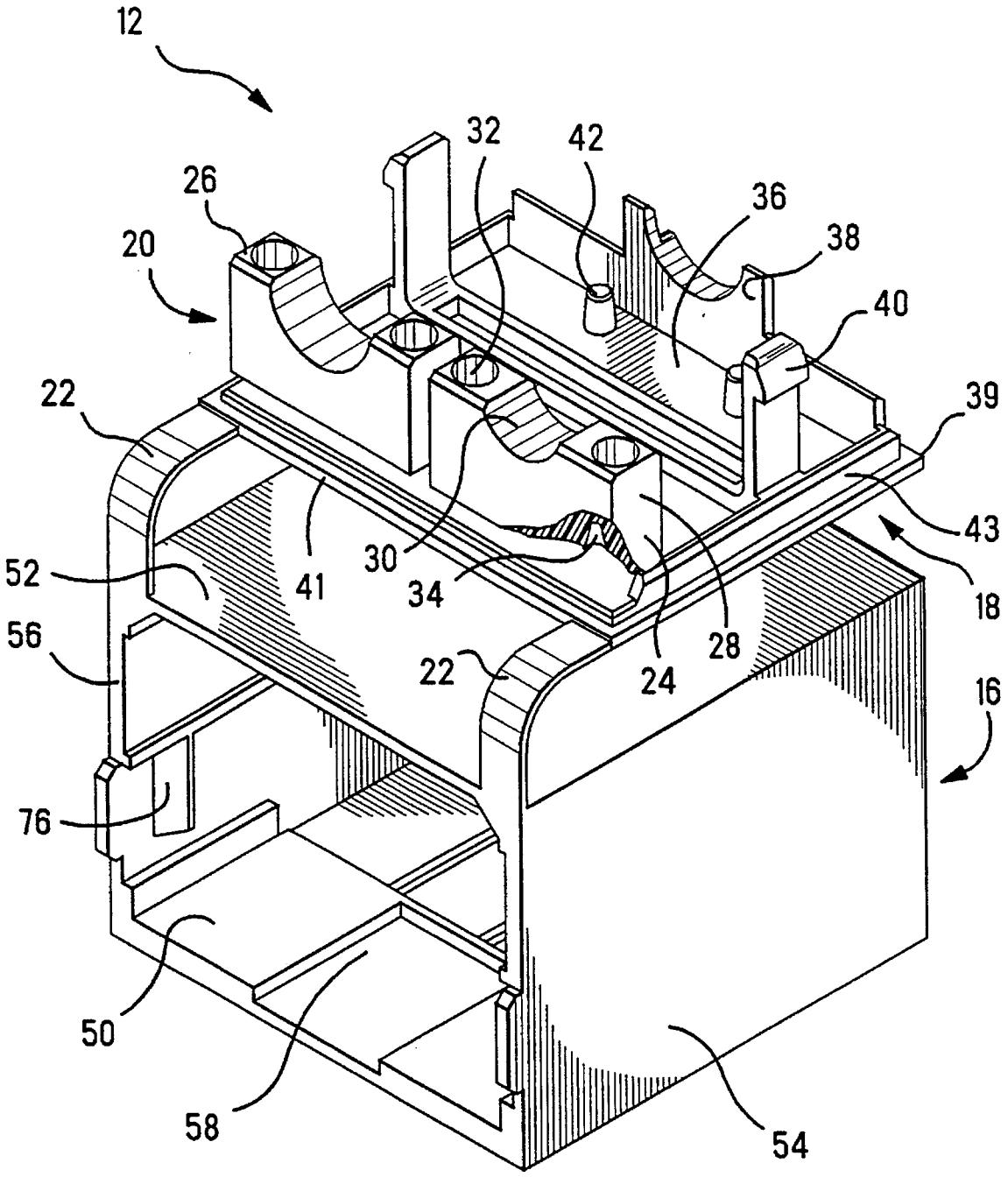
FIG. 3 is an isometric view of a communications connector housing.

With reference now to FIG. 3, the outlet connector housing will be described in more detail. Prior to assembly, in the preferred embodiment, the outlet connector housing 12 is an integral injection moulded plastic part whereby the housing box 16 and housing box cover 18 are attached together by a thin breakable webs 22, and the strain relief means 20 are moulded by thin webs to the housing cover 18. There are two strain relief means attached to the cover 18, a small diameter strain relief means 24 and a large diameter strain relief means 26. The strain relief means comprise a rectangular prismatic block portion 28, a cylindrically shaped indent 30 for receiving a cable thereagainst and smooth-walled cylindrical bores 32 for receiving tap screws on either side of the indent 30. On an opposing side of the strain relief block 24 with respect to the indent 30 and tap screw bores 32 are a pair of frusto-conically tapered provisional supporting holes 34, which is best viewed in the partially broken away view of strain relief means 24 in FIG. 3. It should be understood that strain relief means 26 has similar frusto-conical supporting holes 34.

Still with reference to FIG. 3, the cover 18 is shown comprising a main cover base 36, a transverse short cover portion 38 along a bottom edge 39 of the cover base 36, resilient locking latches 40 and provisional strain relief means supporting pegs 42. On a top edge 41 of the cover 18 is a protrusion 44 on an outer side of the cover as shown in FIG. 4.

Figure 4:
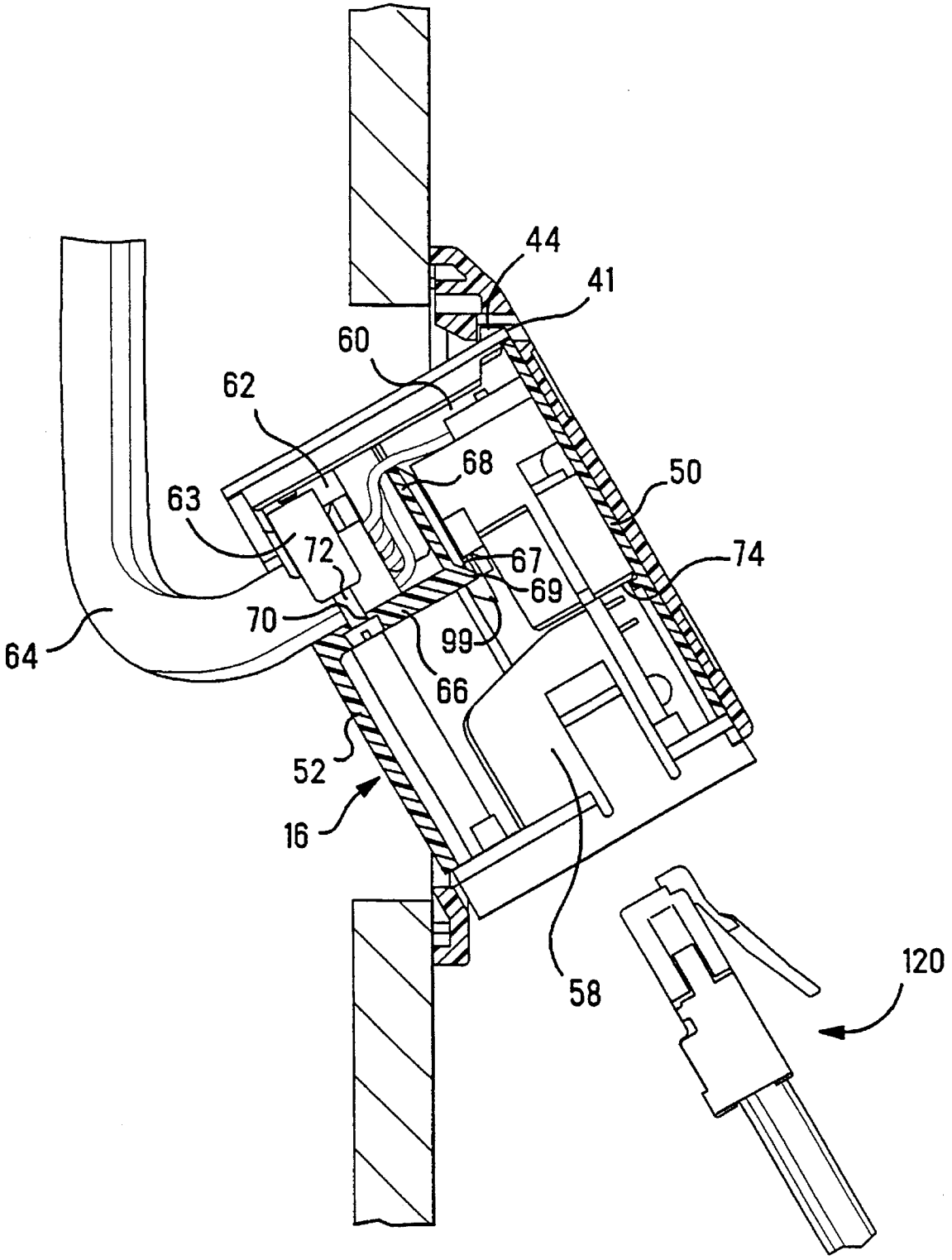
FIG. 4 is a cross sectional view through a data communications outlet.

Referring to FIGS. 3 and 4, the connector housing box 16 is shown having a top wall 50, an opposing lateral bottom wall 52 and adjacent side walls 54, 56. The four walls 50, 52, 54, 56 define a front cavity section 58 for receiving the communications connector insert 14, a rear upper cavity section 60 for receiving the internal edge connector 10, and a rear lower cavity section 62 for receiving a communications cable 64. Further, within the cavity area 62 is a strain relief means receiving cavity 63. Inside the connector housing box 16 and separating the first and third cavity sections is a structural wall 66 attached to the bottom wall 52 and projecting transversely therefrom to a mid height between the top and bottom walls 50, 52. At a top edge of the wall 66 is a transverse rearwardly departing separating wall 68 that separates the second cavity section 60 from the third cavity section 62. Both walls 66 and 68 span substantially from one side wall 54 to the other side wall 56. The structural wall 66 has screw locating holes 70 therein for receiving strain relief tap screws 72. On the top wall 50, between first and second cavity sections 58, 60, is a low rib 74 transverse to the side walls 54, 56. On the side walls 54,56 in the first cavity section 58, are latch recesses 76 (FIG. 3). On a top edge of the structural wall 66 is a tapered camming surface 671 for engaging latching means.

Referring back to FIG. 1, the communications outlet connector insert 14, is shown comprising a printed circuit board 80 with electrical traces thereon, a connector receptacle portion 82, a cover plate 84 and attached thereto locking latches 86. It should be appreciated that a telephone connector is shown at 82 in FIG. 1, but that any form of connector is available, including data, coaxial, optical, etc.

Figure 5A:
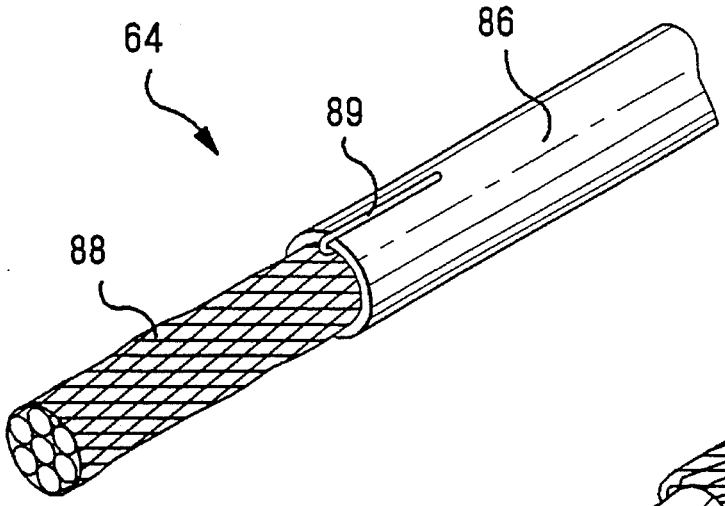
FIGS. 5*a* and 5*b* illustrate the preparation of a data communications cable for connection with a connector.
Figure 5B:
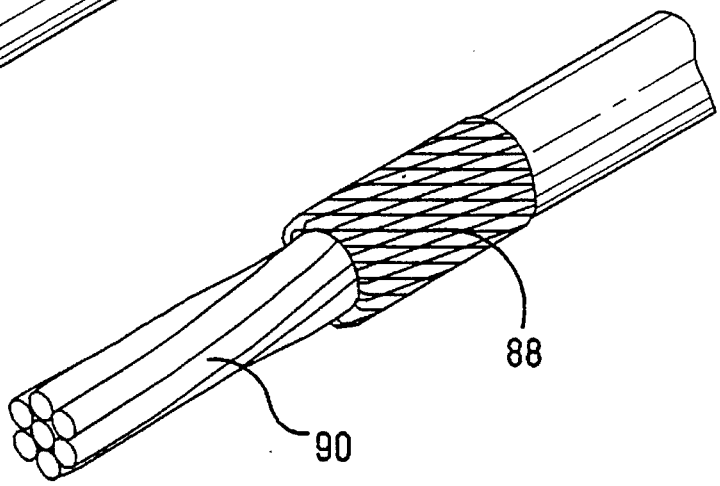

Referring now to FIGS. 5*a* and 5*b*, a typical communications cable 64 is shown comprising an insulative cladding 86, outer shielding 88, a drain wire 89, and comprised therein insulative conducting wires 90. The cables 64 are typically prepared by dressing the drain wire 89 against the insulation 89 (FIG. 5A), and then dressing the shielding 88 rearwardly over the drain wire 89, and insulation 86.

Referring to FIGS. 6*a* to 6*d*, the edge connector 10 is shown comprising a cover 92, a housing 94, and insulation displacement connecting barrels 96. The housing 94 has a printed circuit board receiving slot extending from a front mating face 100 rearwards past terminals contacts (not shown) that are electrically connected to the barrels 96. The cover 92 has a row of cylindrical cavities 102 for receiving the barrels 96, the cavities 102 having longitudinal wire receiving slots 104 that extend from the mating face 103 of the barrel receiving cavity 102 to a stuffer bridge portion 106.

The assembly of the communications outlet connector 6 from the various kit parts will now be disclosed. Referring first to FIG. 5, preparation of a shielded data communications cable 64 is shown. A portion of the outer insulative cladding 86 must first be removed as shown in FIG. 5*a* and the shielding 88 then pulled reversely over the insulative cladding 86 thereby exposing the individual insulative wires 90 along the portion where the insulative cladding 86 was removed.

Figure 6A:
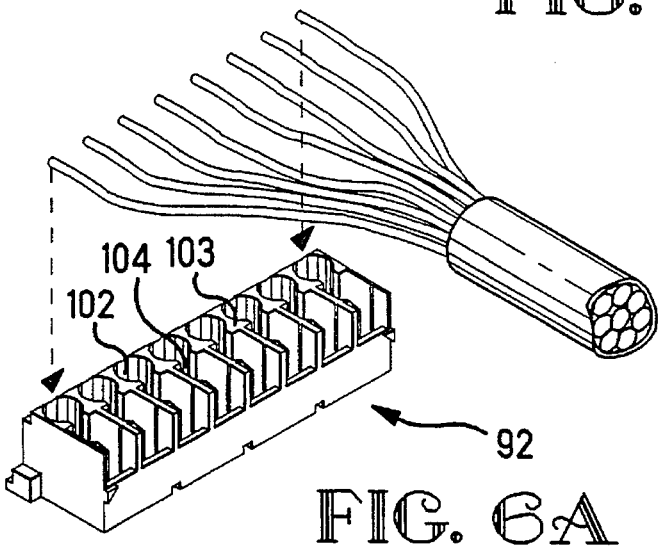
FIGS. 6*a* to 6*d* illustrate the termination of the cable to an edge connector.
Figure 6B:
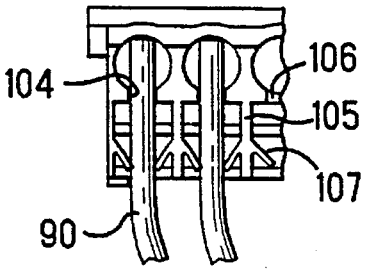
Figure 6D:
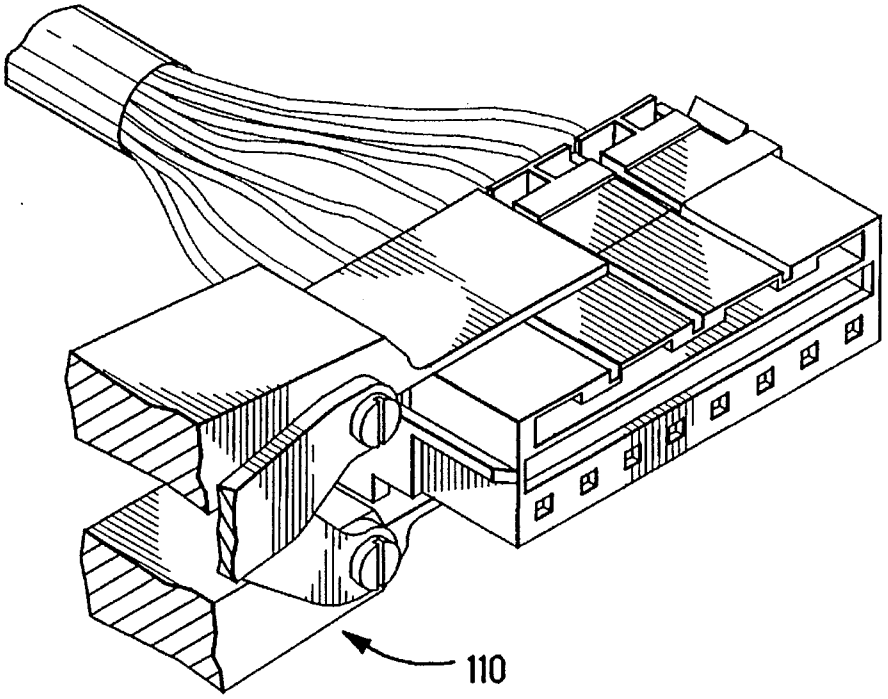
Figure 6C:
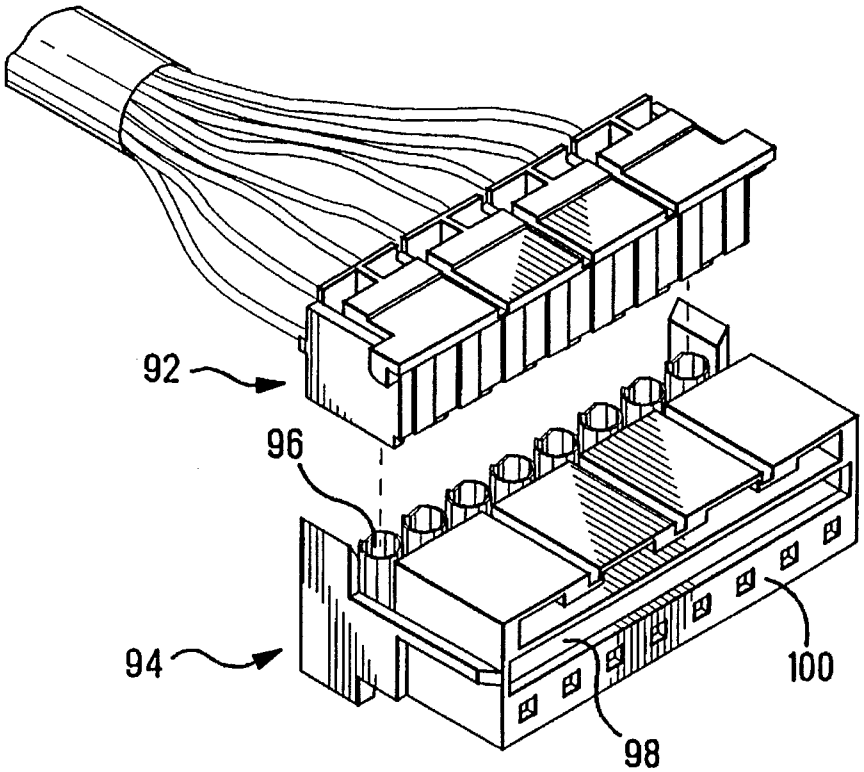

Referring now to FIG. 6*a*, the wires 90 must then be separated such that they can be individually pushed between the barrel cavity slots 104 of the edge connector housing cover 92, whereby as shown in FIG. 6*b* the wire end is abutting the opposing side of the cavity 102 with respect to the slot 104. As shown in FIG. 6*b* resilient clasps 107 provisionally retain the wires 90 to the cover 92. Once all of the wires 90 are inserted into their respective slots and holes 104, 102, the cover can then be aligned to the housing 94 such that the barrels 96 are inserted into the cover cavities 102. As the cover 92 and housing 94 are squeezed together, slots in the insulation displacement barrels 96 cut through the insulation and make electrical contact with the wires 90 in a similar way to the already well known insulation displacement technology. A specially adapted pair of pliers 110 such as shown in FIG. 6*d*, can be used to provide the sufficient cable termination force.

Figure 7:
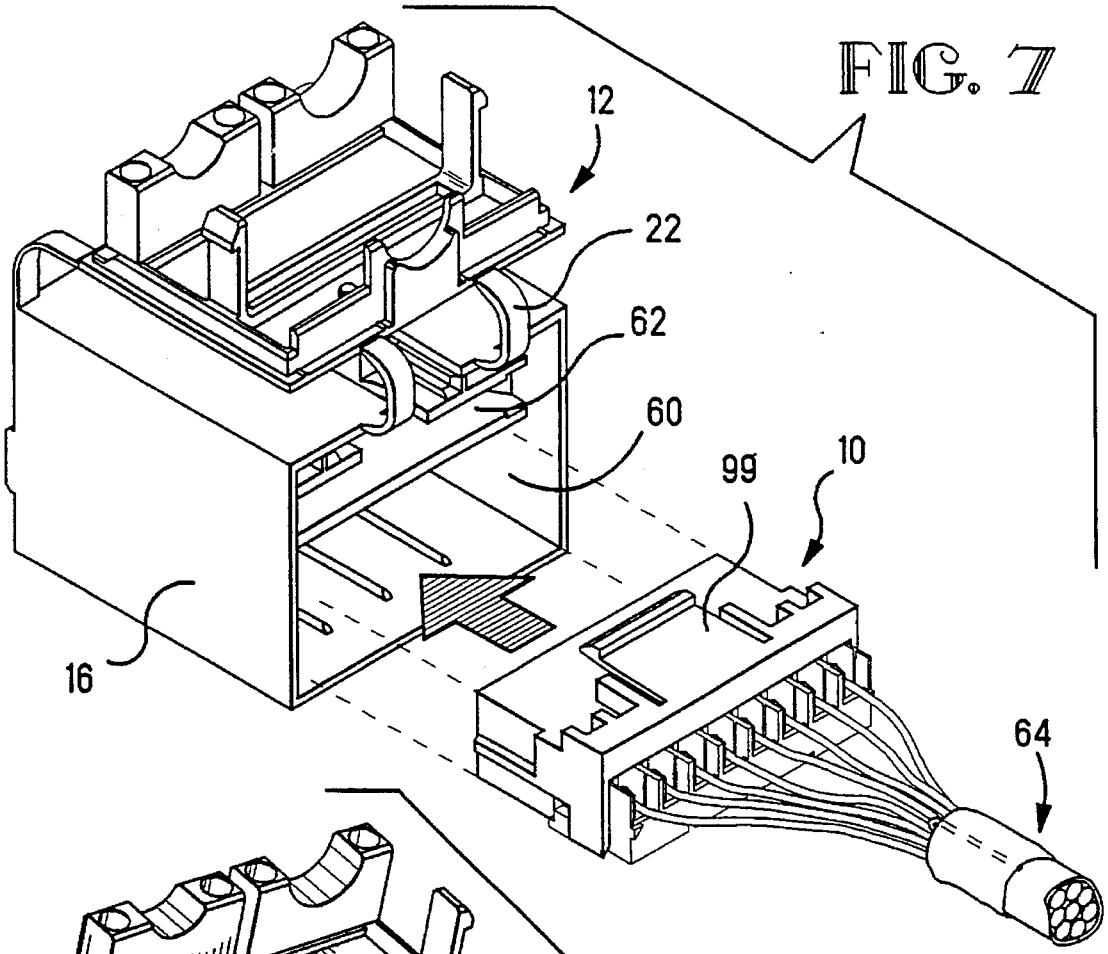
FIGS. 7 to 11 illustrate the assembly of a communications outlet connector, whereby

With reference to FIG. 7, the terminated connector 10 can then be fully inserted into the second rear receiving cavity 60 of the connector housing box 16 until the latch 99 engages with the top edge 69 of the internal structural wall 66 (see FIG. 4) for retention of the connector 10 in the connector housing box 16. As also shown in FIG. 4, the oblique camming surface 67 of the wall 66 serves to resiliently bias the latch 99 over the wall top edge 69.

Figure 8:
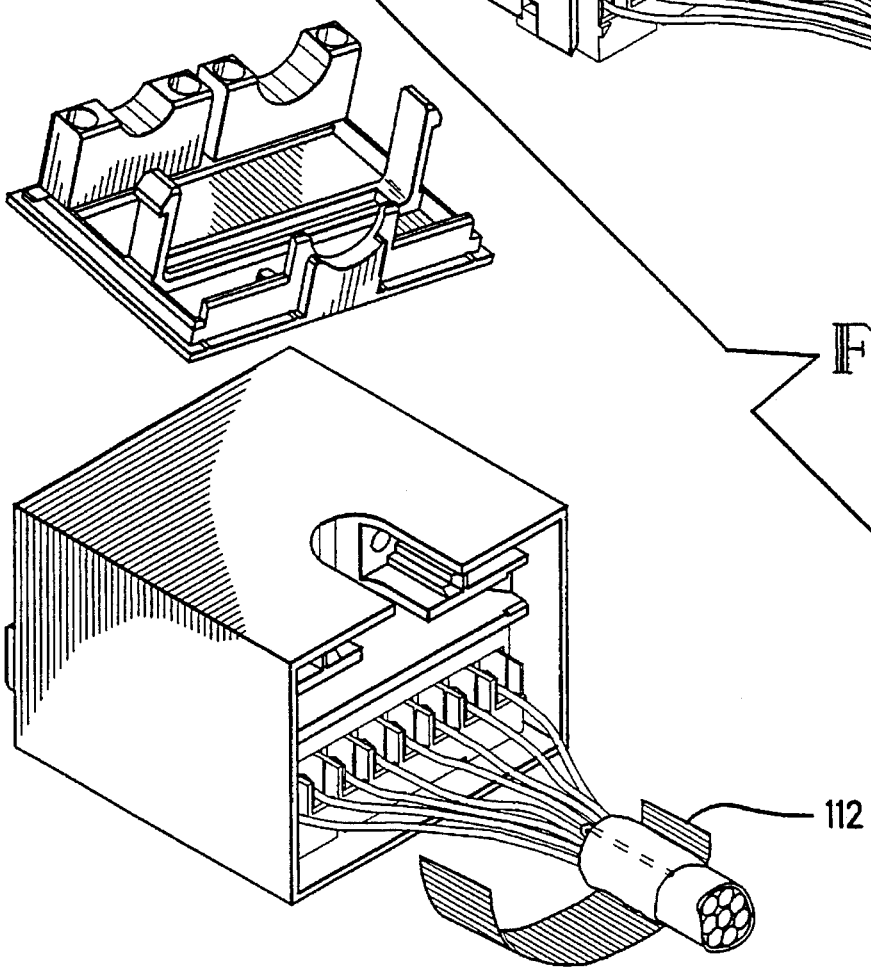

With reference to FIG. 8, the cover 12 can then be separated from the connector housing box 16 by breaking off the thin webs 22 from the housing 16 and from the cover 12. The plastic material of the connector housing kit 12, has a certain resiliency so that the webs 22 do not break during handling and transport, this resiliency also required for resilient biasing of the locking latches 40, however the material must also be relatively brittle such that one can snap off the connecting webs 22 at the joints with the housing and the cover such that there is a clean separation. Additionally, the section of the web where it joins the housing or the cover, can be reduced such that rupture is favored along this reduced section join.

To correctly hold the shielding and stop fraying of the braided wires, one can wrap a ductile copper foil 112 around the exposed reverse folded cable shielding, as shown in FIG. 8.

Figure 9:
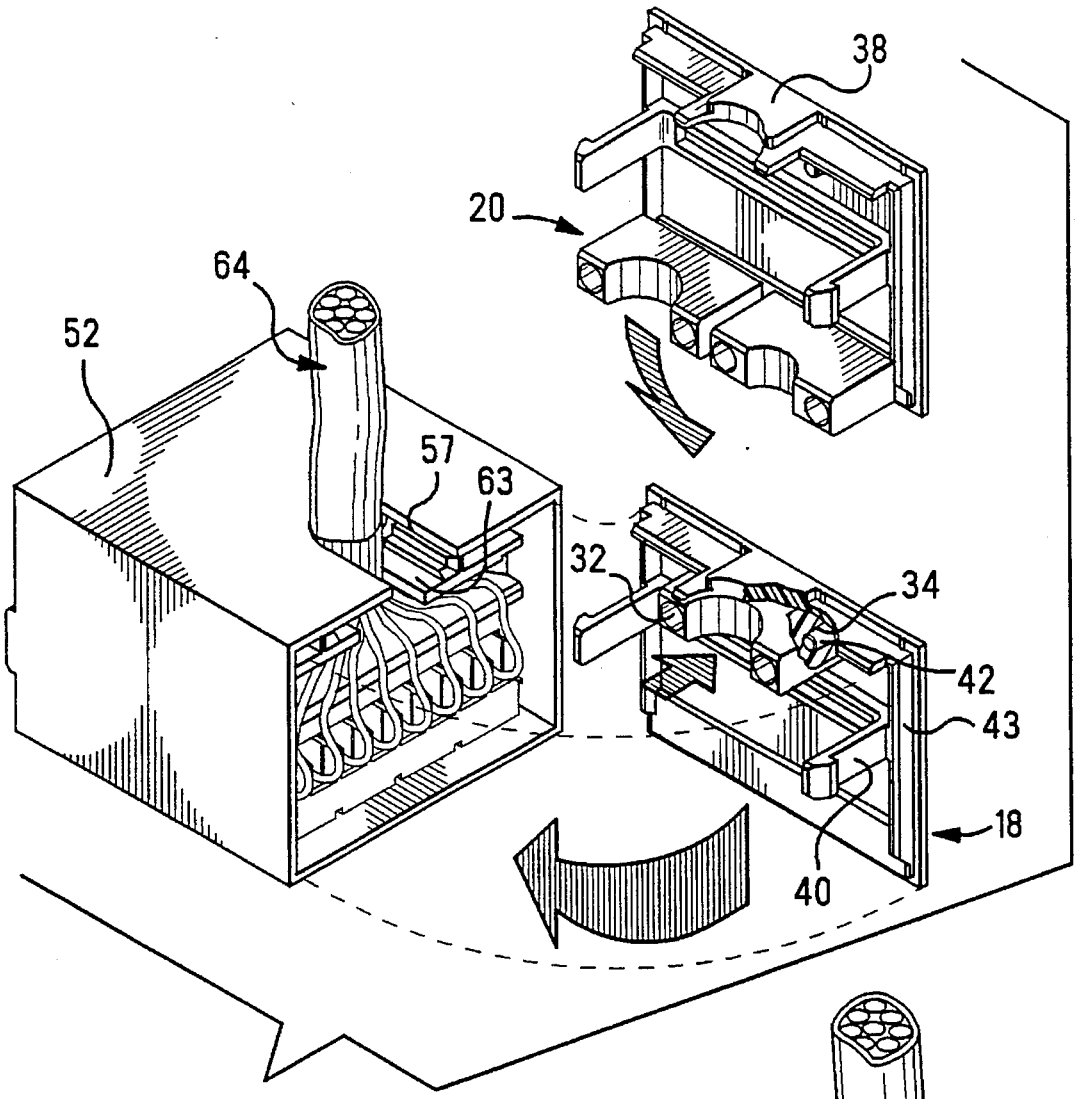

Referring to FIG. 9, the cable 64 can then be rotated through 90° such that it fits through the slot 57 of the housing box bottom wall 52. Both of the strain relief means 20 can then be broken away from the cover 18 whereby the strain relief means having the appropriate indent size for adaptation to the size of the cable 64 is chosen and then pressed onto the provisional supporting pegs 42 that engage with the provisional supporting holes 34 of the strain relief means. Due to the tapered mating surfaces of the peg and hole, the strain relief means 20 can be retained on the pegs 42 because of the wedge effect with the mating holes 34. If a wedge is pushed into a corresponding wedge slot with a certain insertion force, the component of force normal to the mating surfaces is very large if the tapered angle is very small, causing (elastic) deformation of the material such that when the insertion force is reduced to zero, this elastic compression force subsists and causes a frictional force between the wedge and cavity mating surface, thus retaining the wedge to the cavity walls. Thus, as mentioned above, the strain relief means 18 is frictionally retained to the supporting pegs 42 of the cover and the cover 18 can be closed over the rear section of the connector housing box 16, whereby the slot cover portion 38 of the cover is inserted into the slot 57 of the housing box 16 such that it substantially closes the slot opening around the cable 64.

The ledge 43 that lies close to the edges of the cover, serves to position the cover 18 with respect to the housing box 16. The resilient latches 40 engage with latch recesses (not shown) in the housing side walls 54, 56 for retention of the cover 18 to the housing box 16, the rear section 60, 62 of the outlet connector module thus being substantially closed off from the exterior.

The strain relief means 20 is positioned on the cover such that when the cover is latched to the housing box, the strain relief means is inserted into the strain relieving means receiving cavity 63 until the strain relieving means indent 30 is close or touching the cable 64, and more particularly the folded over shielding part of the cable. Advantageously, the cable 64, as shown in FIG. 9, passes transversely through the strain relief cavity 63, and through the slot 57, thereby placing the shielding against the rear edge of the slot 57.

As has been already mentioned above, two different strain relieving means are provided with the cover, each strain relieving means 20 having an indent 30 with different indent diameters. Depending on the diameter of the cable 64, the strain relieving means 20 with the indent 30 having the most appropriate size for the diameter of the cable, is chosen. Because the cable is deformable, each strain relieving means indent 30 can be used for a range of cable diameters, for example the first strain relieving means could be adapted for cable sizes ranging from 5 to 8 millimeters in diameter, and the second strain relieving means could be adapted for cable sizes between 8 and 10 millimeters in diameter. One therefore provides strain relieving means with the outlet kit for cables that range in size from 5 to 10 millimeters in diameter.

Figure 10:
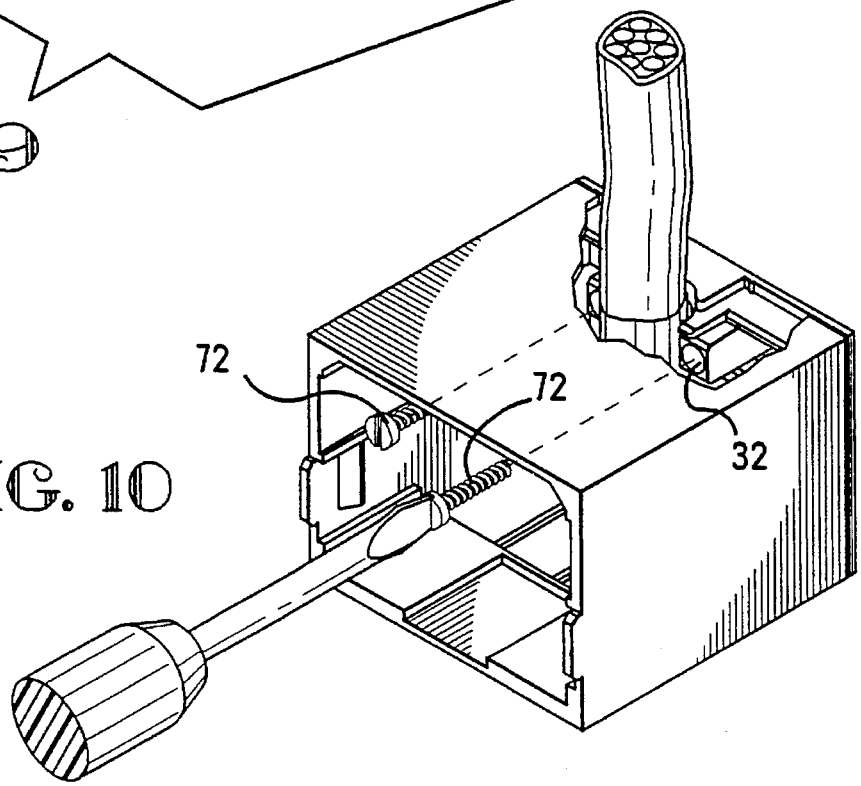

It should be understood that, the provisional supporting pegs 42 are so located, that when the cover is positioned over the rear face of the box 16, that the shielding strain relief means 24, 26 is inserted into the cavity 63,with the apertures 32 aligned with apertures 70 of wall 66, see FIG. 4. Referring now to both FIGS. 4 and 10, self tapping screws 72 are inserted through the holes 70 in the housing box inner structural wall 66 until they abut the screw bores 32 of the strain relief means 20 that flank the cable 64. In the preferred embodiment the screw bores 32 have no thread, but rather a smooth wall cylindrical surface having a diameter which is less than the outer diameter of the screw thread, such that the screws 72 can be "tapped" into the bores by cutting a screw thread in the plastic wall of the screw bore. Tightening of the screws on either side of the cable draws the shielding strain relief member 24, 26 forward, off of the pegs 34,42 and against the cable, such that the member 24, 26 squeezes and firmly grips the cable 64 between the strain relief means 20 and the box structural wall 66. In the preferred embodiment of the invention, the box 16, and the strain relief member 24,26 are conductive, preferably plated plastic, which forms a common ground with the cable shield 88.

Figure 11:
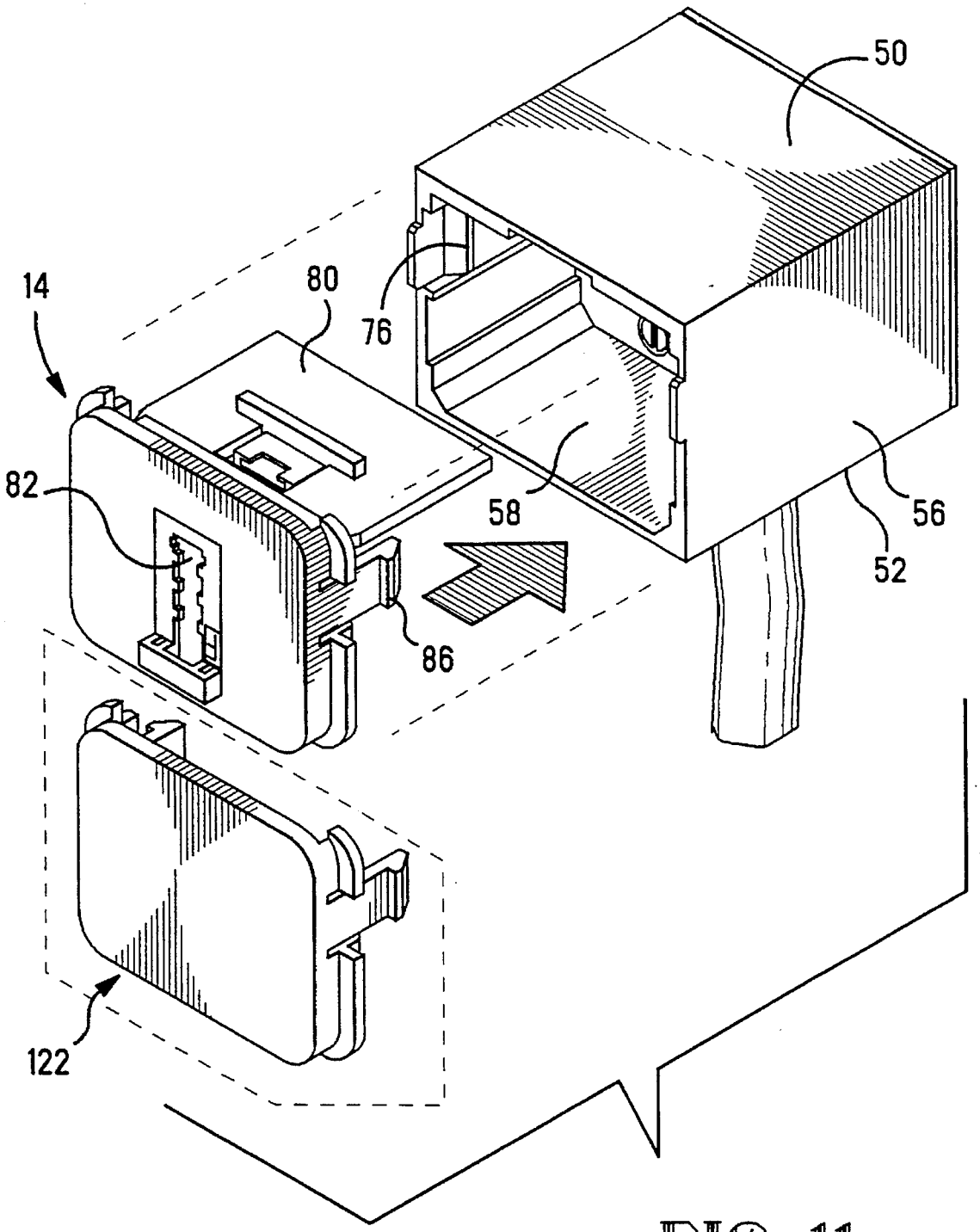

Referring to FIG. 11, the insert 14 can then be inserted into the front receiving cavity 58 of the housing box 16, whereby the printed circuit board 80 is inserted into the slot 98 (FIG. 6*c*) of the edge connector 10 for electrical connection therebetween. Circuit traces (not shown) on the top and bottom surfaces of the board 80 make electrical contact with terminals in the edge connector 10. When fully inserted, the insert 14 is locked to the connector housing box 16 by the latches 86 of the insert that engage in the recesses 76 of the housing box side walls 54, 56. The insert thus substantially closes off the front cavity section 58 of the connector box 16 from the exterior.

The connector receptacle 82 serves to receive and make electrical connection with a plug 120 as shown in FIG. 4. Such inserts 14, may comprise electronic circuitry that processes the electrical data transmission between the cable 64 and the plug 120, whereby the inserts can be quickly removed by simply unclipping the latches 86 as shown in FIG. 12 with help of a screwdriver, and replacing the insert 14 with another insert either having for example different electronic circuitry, a different wire, arrangement, or adapted to different plug types. These inserts are already known and available by the applicant. If the outlet connector 6 is redundant and for possible use in future applications, one can replace the connector insert 14 by a blind insert 122 that simply acts as a cover for the front cavity section of the housing box 16.

Advantageously therefore, the kit described in the present disclosure is cheap to manufacture because the cover 18, the strain relief means 20 and the box 16 can be manufactured in only one plastic molding, which also has the advantage of avoiding the extra expense in handling, packaging and stocking separate loose pieces which is advantageous not only for the manufacturer, but also for the end user.

Advantageously also, is the provision of two strain relief means that cope for a wide range of cable diameters.

Yet advantageously, are the provisional supporting pegs on the cover that cooperate with supporting holes on the strain relief means to enable very easy and rapid assembly of the strain relief means and cover. Additionally, the self tapping screws for fixing of the strain relief means ensures a very secure clamping of the cable, whilst only requiring plain holes in the strain relief means which are very simple to mold.

In the assembled state of FIG. 12, the communications outlet connector module 6 is ready to receive a plug 120 for electrical connection between the plug 120 and the communications cable 64, however the outlet connector 6 module is mountable to a structure as will be described further below.

Referring to FIG. 13, an outlet cover 18 is shown comprising a base plate 130 having a large central hole 131, and on opposing edges of the hole 131 projecting perpendicularly Outwards from the base 130, is a pair of triangular shaped side walls 134. A face plate 132 spans between opposing top edges 135 of the triangular walls 134, the face plate 132 also joining a top edge 137 of the base plate 130. The pair of spaced apart triangular side walls 134 and the face plate 132 define triangular halfbox inner cavity 139 that can receive substantially half of the communications outlet connector module 6 whereby the plane of the base plate 130 would be approximately parallel to a diagonal joining a top rear corner 140 to a bottom front corner 142 of the outlet connector module. The sidewalls 134 and face plate 132 thus define a triangular half-box protruding shell 136. Below the top edge 137 and jutting into the cavity area 139 is a resilient latch projection 144, and on an opposing bottom edge 146 of the base plate hole 131, is an oblique lead in projection 148 substantially parallel to the face plate 132. The base plate 130 also has holes for receiving mounting screws 150.

Figure 13B:
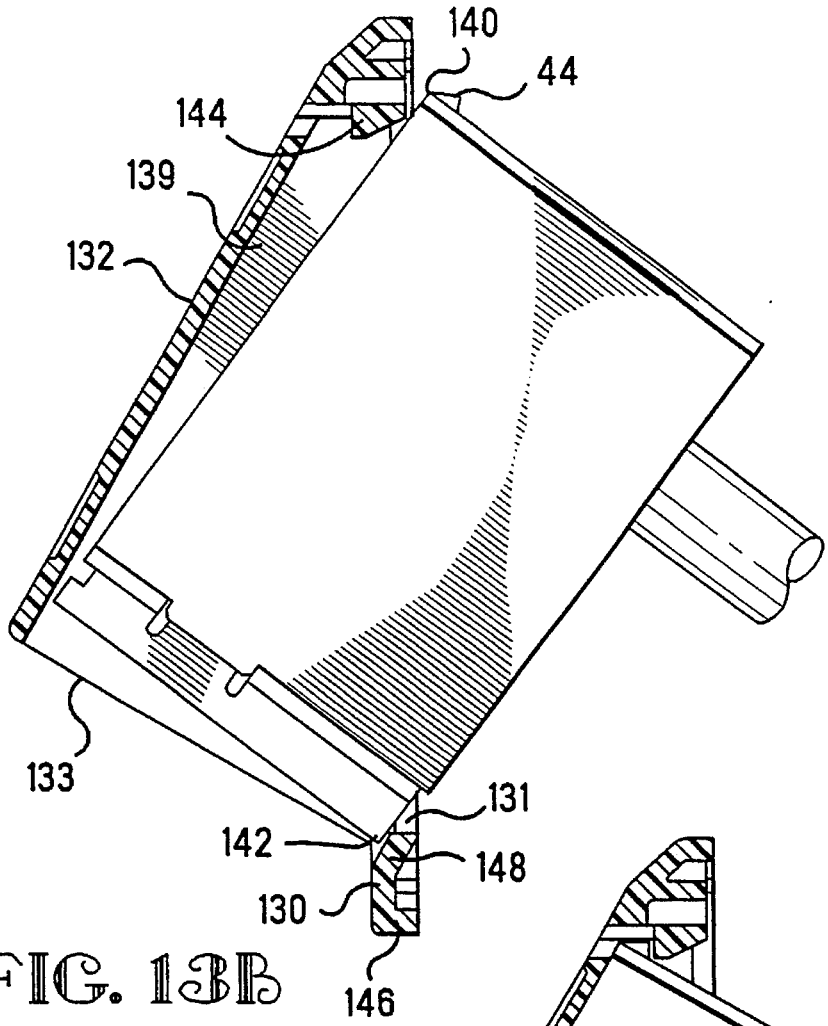
Figure 13C:
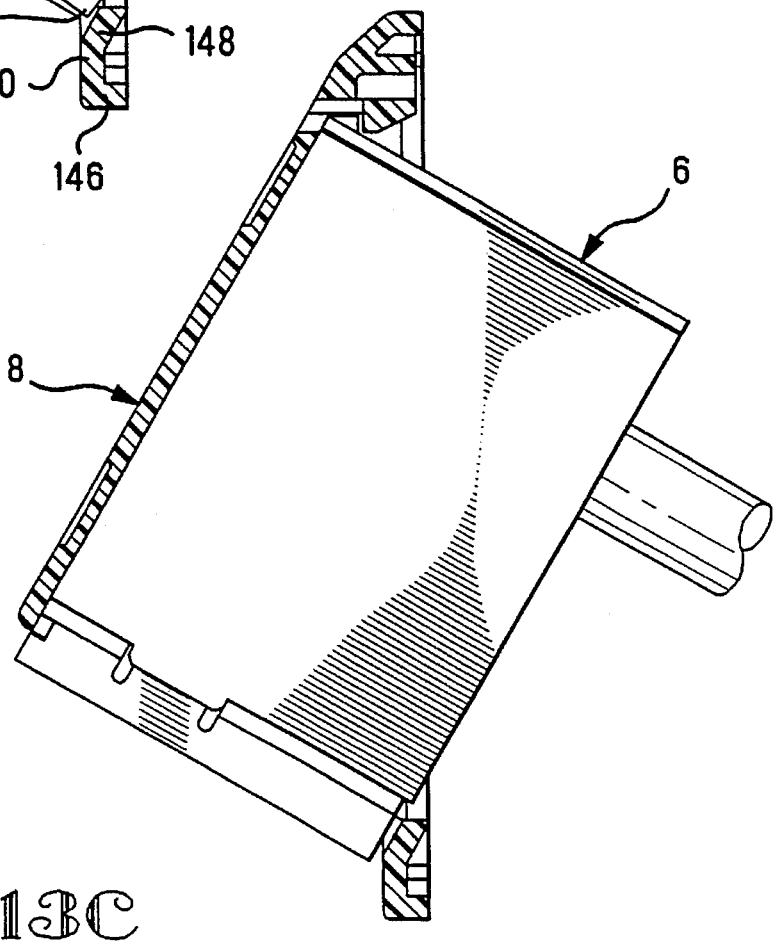

Still referring to FIG. 13, the outlet connector module 6 can be mounted to the outlet cover 8 by tilting the outlet connector as in FIG. 13*b*, such that the opposing corners 140, 142 are in a plane almost parallel to the cover base plate 130 with the insert facing the cover opening 133. The insert front plate 84 is inserted between the lead in projection 148 and face plate 132 until the housing box cover projection 44 abuts the outlet cover projection 144. By exerting a force on the outlet connector modulel approximately perpendicularly towards the cover base plate 130, the projection 144 is resiliently biased outwards such that the connector projection 44 is inserted there past, and engages there behind in a locking engagement such as shown in FIG. 13*c* or FIG. 4.

Figure 14:
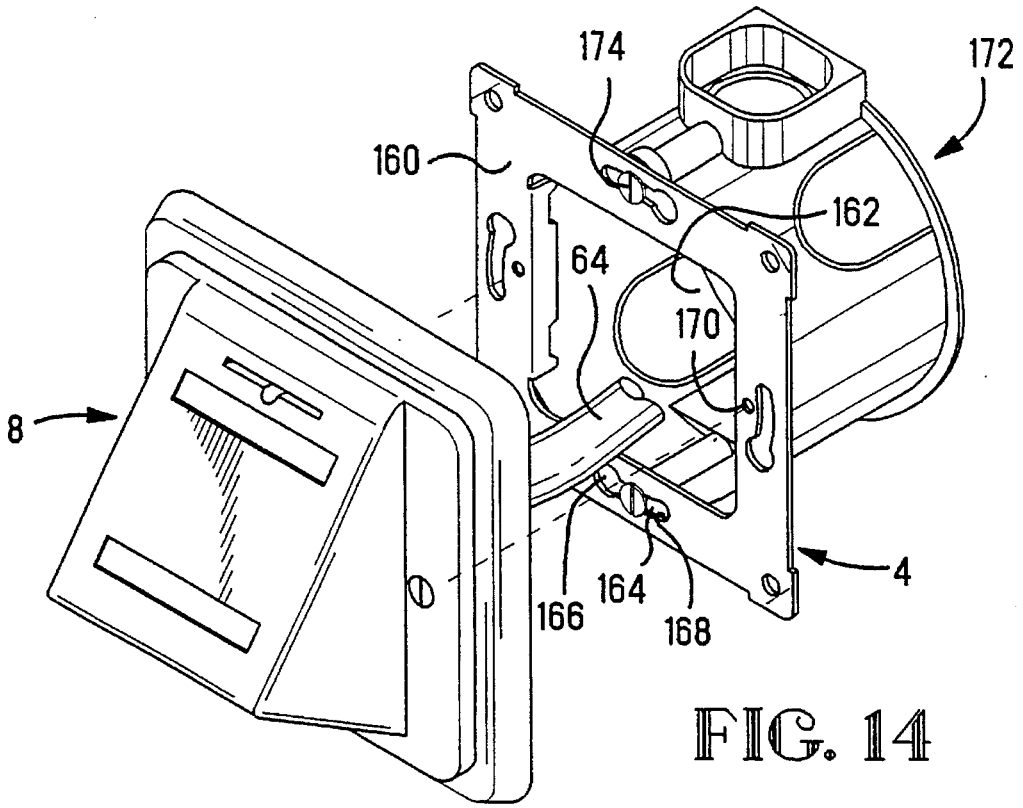
FIGS. 14 to 17 show different mounting possibilities of the communications outlet connector and cover to a structure.

The assembled outlet connector 6 and outlet cover 8 are thus locked together and can then be securely mounted to a structure with the screws 150. Referring to FIG. 14, the mounting frame 4 is shown comprising a metal frame 160 with a central hole 162 for receiving the outlet connector module bottom rear triangular half-box 6, elongate structural mounting holes 164 with a large diameter portion 166 and a smaller width adjacent slot 168, and cover-mounting threaded holes 170. The frame 4 is mountable to a structure 172, 172', 172", 172'" by screws 174. The larger diameter portion 166 of the structure mounting holes 164 has a diameter larger than the head of the screws 174 such that the screws can be loosely threaded to the structure 172 before mounting the frame 4 thereto, and then aligning the enlarged hole sections 166 of the frame 4 with the screws 174 so that the frame can be inserted there past. Once the enlarged section 166 has passed the heads of the screws 174 the frame can then be rotated such that the threaded portion of the screws 74 passes in the slot portion 168, the slot portion 168 having a gap smaller than the diameter of the screw heads. The screws 174 can thus be tightened, securely fixing the frame 4 to the structure 172. To release the frame from the structure 172 one simply has to loosen the screws 174, rotate the frame until the screw heads align with the larger hole section 166, and pull off the frame.

Once the frame 4 is mounted to the structure 172, the outlet cover 8 and outlet connector 6 can be securely fixed to the frame 4 with the cover screws 150, whereby the rear diagonal half of the outlet connector module 6 projects behind the frame 4 into a spacing within the mounting structure 172.

Figure 15:
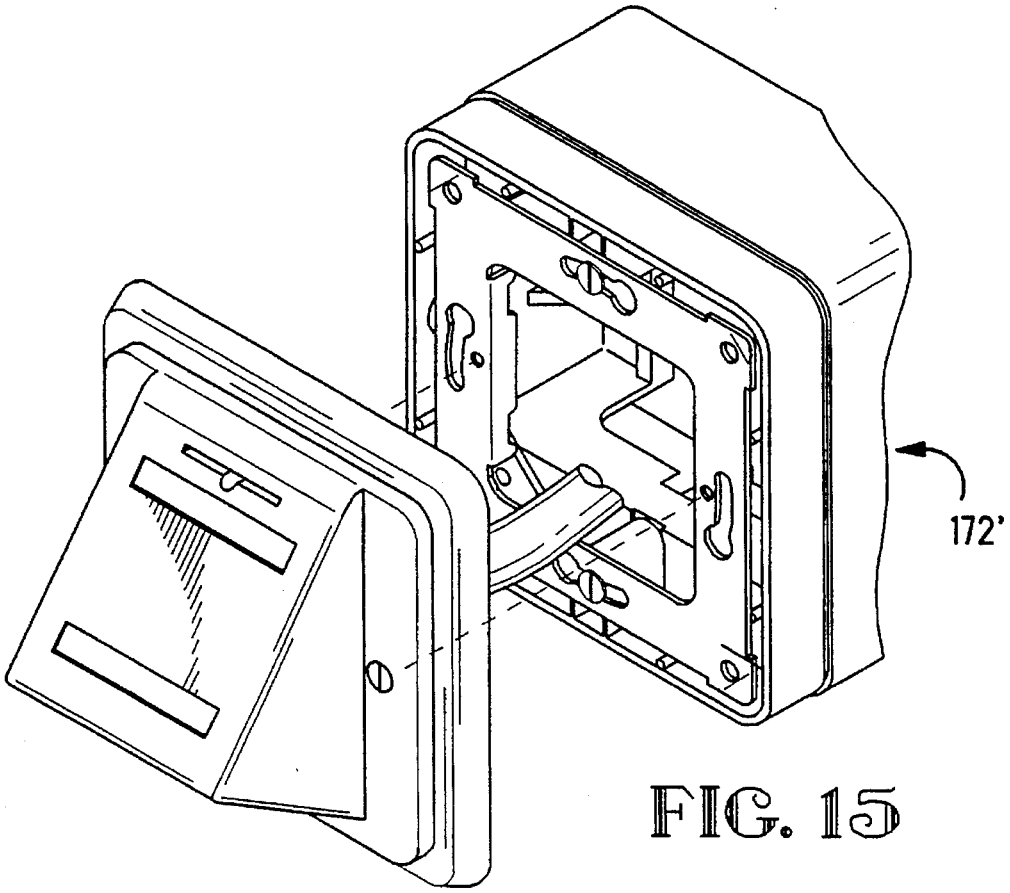
Figure 16:
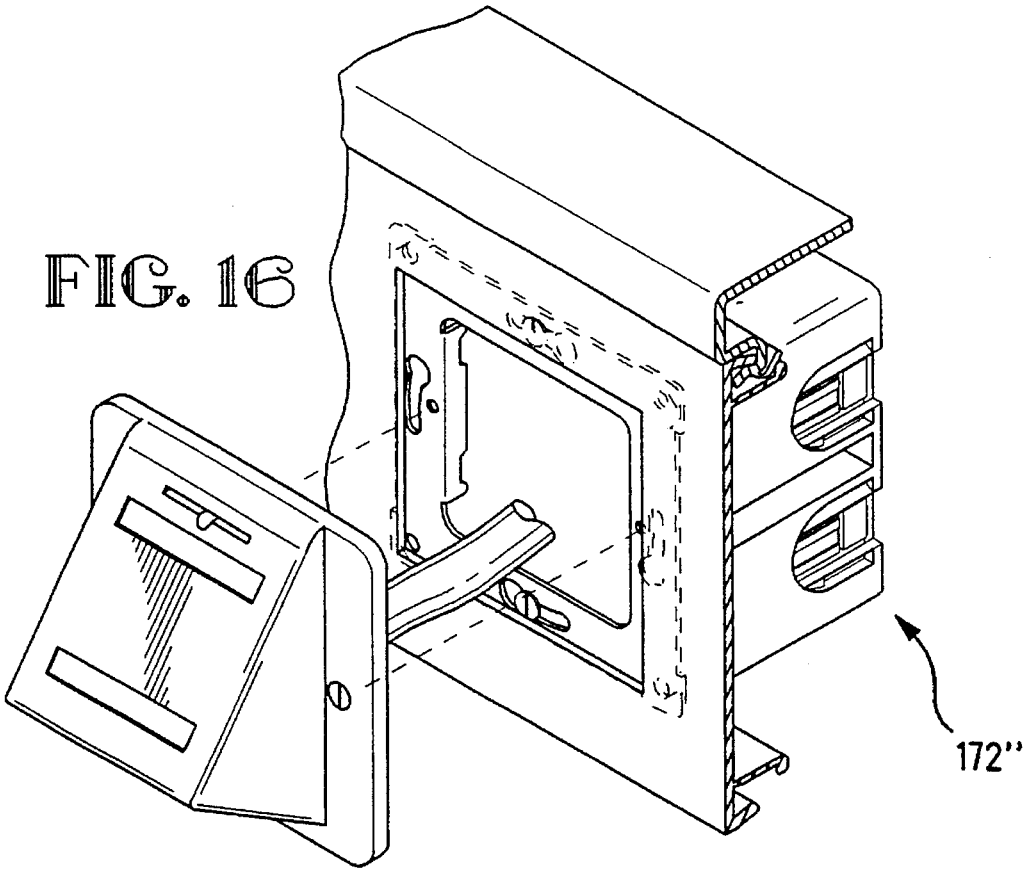
Figure 17:
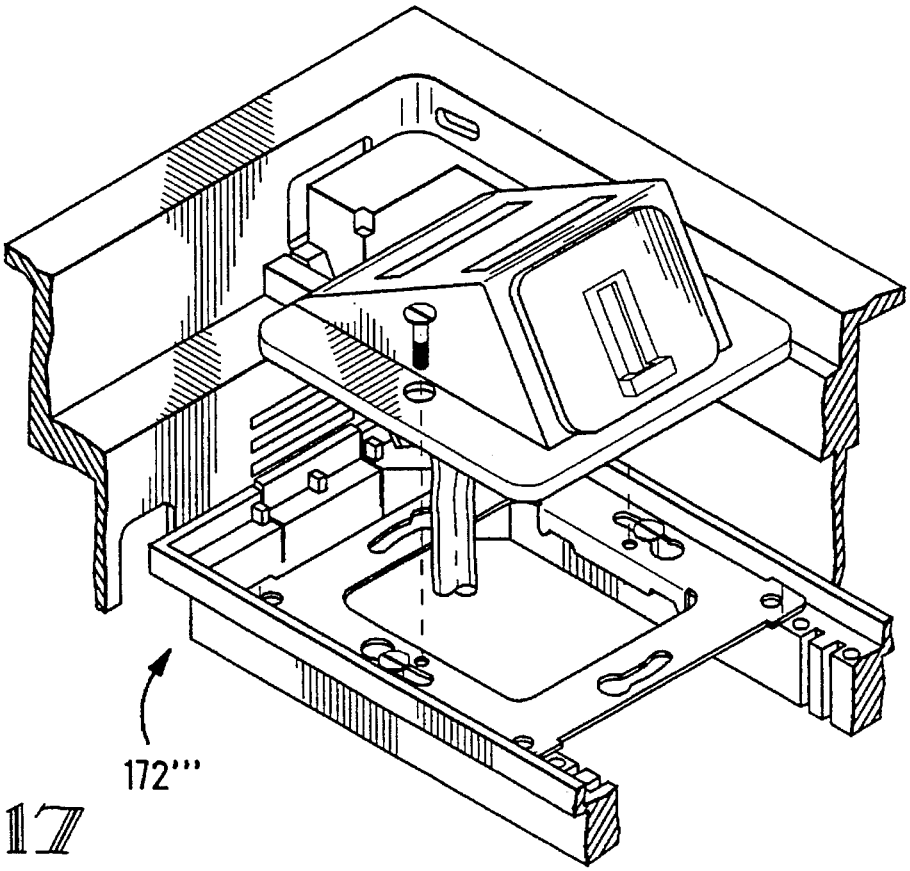

FIGS. 14 to 17 show various possibilities of mounting the outlet cover and connector to various structures whereby FIG. 14 depicts an inlaid wall mount 172, FIG. 15 a surface mount 172', FIG. 16 mounting in a cable canal structure 172", and FIG. 17 mounting in a floor structure 172'".

Advantageously, the diagonal disposition of the outlet connectors 6 mounted to the outlet cover 8, requires less mounting depth to be provided behind the mounting frame 4 than if the outlet connector were to be mounted projecting perpendicular to the cover base plate 130.

Another advantage of the diagonal mounting disposition of the outlet connector 6, in conjunction with the reduced required structural depth, is that the plug receiving receptacle 82 projects obliquely downwards in a wall mounted assembly, this disposition protecting an inserted plug 120 from objects or people liable to inadvertently hit the plug 120. An object moving close to the outlet cover 8 mounted on a wall in a building for example, will inmost cases hit the side walls 134 or the face plate 132 of the cover 8 as opposed to hitting the plug 120 which would easily cause damage to the plug 120 and the insert 14.

Another advantage of this disposition when mounted to a building wall for example, is that because of the downwardly pointing receptacle part 82, there is better protection from dust and liquids.

Yet another advantage, of this disposition, is that it is also well adapted for floor mounted versions, whereby having the outlet connector mating face pointing obliquely upwards is usually a preferred disposition, rather than having the outlet connector mating face point vertically upwards.

Advantageously also, locking the outlet connector to the outlet cover by the latch means 144, 140 and then mounting the cover 8 to a structure 172 with screws 150, means that the cover can be easily unscrewed from the structure and the whole connector pulled out from the structure allowing rapid and very good access to the outlet connector 6 so that reparations or modifications such as changings the insert 14, can be easily done.

We claim:

1. A communications outlet kit for electrical connection between an electrical communications cable and an external connector, the outlet kit comprising a connector module, the connector module comprising a housing, an insert for electrical connection to the external connector, and a connector for electrical connection between the insert and the communications cable, the insert and the connector mountable to the housing; the outlet characterized in that the housing is one integral part that is breakably separable into individual housing components for assembly of the connector module.

2. The outlet kit of claim 1 characterized in that the housing components comprises a housing box and a cover, the housing box having a front cavity section for receiving the insert and rear cavity section for receiving the communications cable connector, whereby the cover is securely fixable to the rear of the housing box such that it substantially closes the rear cavity section.

3. The outlet kit of claim 2 characterized in that the cover and housing box are attached together by thin breakable webs.

4. The outlet of claim 1 characterized in that the housing components comprises at least one strain relief member for securing of the cable to the housing.

5. The outlet kit of claim 4 characterized in that the strain relief member is attached on the cover.

6. The outlet of claim 4 characterized in that there are two strain relief member.

7. The outlet kit of claim 4 characterized in that each strain relief member, is adapted to strain relieve a different cable size range.

8. The outlet of claim 4 characterized in that the strain relief member consists of a rectangular shaped bar with a partial cylindrically shaped indent disposed centrally along the length of the bar and having bores such that the bar can be fastened to the housing by screws and the cable securely squeezed between the indent of the strain relief means and a structural wall of the housing box.

9. The outlet kit of claim 2 characterized in that the cover has a member for provisional support of one of the separated strain relief members during assembly of the cover to the housing box such that the strain relief member is correctly positionable with respect to the housing box for tight securing of the cable therebetween.

10. The outlet kit of claim 9 characterized in that the provisional support member comprises pegs jutting from the cover that are insertable into peg location holes of the strain relief means.

11. The outlet kit of claim 10 characterized in that the pegs have an outer, slightly conical surface and the holes have a corresponding mating conical surface such that insertion of the peg into the hole with a sufficient insertion force causes frictional retention of strain relief means to the cover pegs.

12. The outlet kit of claim 2 characterized in that the cover has integral resilient latches cooperable with latch recesses in the rear cavity section of the housing box for secure retention thereof.

13. The outlet kit of claim 1 characterized in that the outlet kit also comprises an external communications outlet cover comprising a base frame and a triangular half-box protruding shell such that the connector module is lockable thereto by means whereby the diagonal between opposing corners of the module is approximately parallel to the plane of the cover base frame and approximately half of the module is substantially against the half-box protruding shell.

14. The outlet kit of claim 1 characterized in that the external cover has integral resilient latches cooperable with means of the connector module for locking of the connector module to the cover.

15. The outlet kit of claim 13 characterized in that the outlet kit comprises a mounting frame securely fixable to a structure by means, whereby the cover is securely fixable by means to the mounting frame.

16. A communications outlet kit for secure mounting to a structure and for data communications connection between a data communications cable and an external connector characterized in that the outlet kit comprises a box-shaped connector module for data communications connection between a data communications cable and an external connector, an external outlet cover having a substantially planar base frame portion and a protruding half-box cover portion, and a mounting frame securely fixable to a structure, whereby the connector module is lockable to the cover such that a diagonal between opposing top and bottom corners of the module is approximately parallel to the plane of the cover base frame and approximately half of the module is located substantially within the half-box cover portion, and the cover is securely fixable to the mounting frame.

17. The outlet of claim 16 characterized in that the external cover has integral resilient latches cooperable with a member of the connector module for locking of the connector module to the cover.

18. A communications outlet kit for electrical connection between a communications cable and an external connector characterized in that the outlet kit comprises a connector module having strain relief means for clamping the cable, a housing box and a cover securely fixable to the housing box, the cover having a supporting member cooperable with a supporting member on the strain relief member for provisionally holding the strain relief member in a correct position proximate the cable such that the strain relief member can subsequently be tightened thereagainst thereby tightly clamping the cable between the strain relief member and a structural wall of the housing box.

19. The outlet kit of claim 18 characterized in that the provisional support member comprises pegs jutting from the cover that are insertable into peg location holes of the strain relief member.

20. The outlet kit of claim 19 characterized in that the pegs have an outer, slightly conical surface and the holes have a corresponding mating conical surface such that insertion of the peg into the hole with a sufficient insertion force causes frictional retention of the strain relief member to the cover pegs.

21. The outlet kit of claim 18 characterized in that the strain relief member consists of a rectangular shaped prismatic bar with a partial cylindrically shaped indent disposed centrally along the length of the bar and having bores such that the bar can be fastened to the housing box by screws and the cable securely squeezed between the indent and a structural wall of the housing box.

* * * * *